US006817793B2

(12) United States Patent
Kelsay et al.

(10) Patent No.: US 6,817,793 B2
(45) Date of Patent: Nov. 16, 2004

(54) MEDIA HANDLING DEVICE AND METHODS

(75) Inventors: Curtis G. Kelsay, Boise, ID (US); Paul D. Faucher, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/346,546

(22) Filed: Jan. 17, 2003

(65) Prior Publication Data

US 2004/0141789 A1 Jul. 22, 2004

(51) Int. Cl.[7] ..... B41J 13/00; B41J 15/10; B65H 5/00

(52) U.S. Cl. ..... 400/578; 400/615; 400/621; 271/10; 271/114; 271/116; 271/122

(58) Field of Search ..... 400/578, 615, 400/621; 271/10, 114, 116, 122; 83/603

(56) References Cited

U.S. PATENT DOCUMENTS 4,529,188 A * 7/1985 Sturnick ..... 271/10
4,807,868 A 2/1989 Hirst et al.
5,584,476 A * 12/1996 Marzullo et al. ..... 271/126
5,695,184 A 12/1997 Miller et al.
5,820,275 A 10/1998 Crawford et al.
5,882,002 A 3/1999 Kamei et al.
5,921,539 A 7/1999 Westcott et al.
6,003,855 A * 12/1999 Beaufort et al. ..... 271/9.02
6,059,279 A * 5/2000 Wenthe, Jr. ..... 271/10.13
6,116,797 A 9/2000 Brewington et al.
6,119,841 A 9/2000 Orlamunder
6,170,348 B1 1/2001 Faucher et al.
6,182,550 B1 * 2/2001 Brewington et al. ..... 83/603
6,247,569 B1 6/2001 McGuire et al.
6,382,619 B1 5/2002 Gustafson et al.

* cited by examiner

*Primary Examiner*—Andrew H. Hirshfeld
*Assistant Examiner*—Marvin P. Crenshaw

(57) ABSTRACT

Disclosed herein is a media handling device for handling sheets of media contained in a stack.

3 Claims, 11 Drawing Sheets

MEDIA HANDLING DEVICE AND METHODS

BACKGROUND

Media handling devices are commonly utilized for processing sheets of media into documents. To accomplish this, media handling devices generally perform at least one task such as printing, scanning, binding, and sorting. Media handling devices can also be configured to perform more than one function, such as a four-in-one device that is used for printing, scanning, copying and faxing.

In general, one type of media handling device is used to form images on sheets of media. When used for forming images, media handling devices are sometimes referred to as imaging apparatus, facsimile machines, copiers or printers. The sheets of media may, for example, be paper sheets, transparent plastic sheets, envelopes, cardstock, or labels. These types of media vary in properties such as size, thickness, texture and color. Media handling devices are configured to accept these types and sizes of media.

One type of conventional media handling device (such as a printer) is provided with a first input tray and an auxiliary input tray. The first input tray contains a stack of a first type of media. The auxiliary input tray contains a second type of media. Various mechanisms have been used to selectively pick media from the auxiliary input trays versus the first input tray.

SUMMARY

In one exemplary embodiment a media handling device may include: a pick assembly; a lift transmission; and a clutch assembly disposed between the pick assembly and the lift transmission.

BRIEF DESCRIPTION OF THE DRAWINGS

Illustrative embodiments are shown in Figures of the Drawing in which.

DETAILED DESCRIPTION

Described herein is an exemplary embodiment of a media handling device for picking media from an input tray. In general terms, the present device utilizes a wrap spring to ensure that a pick tire is properly contacts media located in the input tray. Furthermore, this wrap spring may allow for the storage of energy in a return spring. The return spring may cause a pick assembly to be removed from contacting the media when a printing process is complete.

Figure 1:
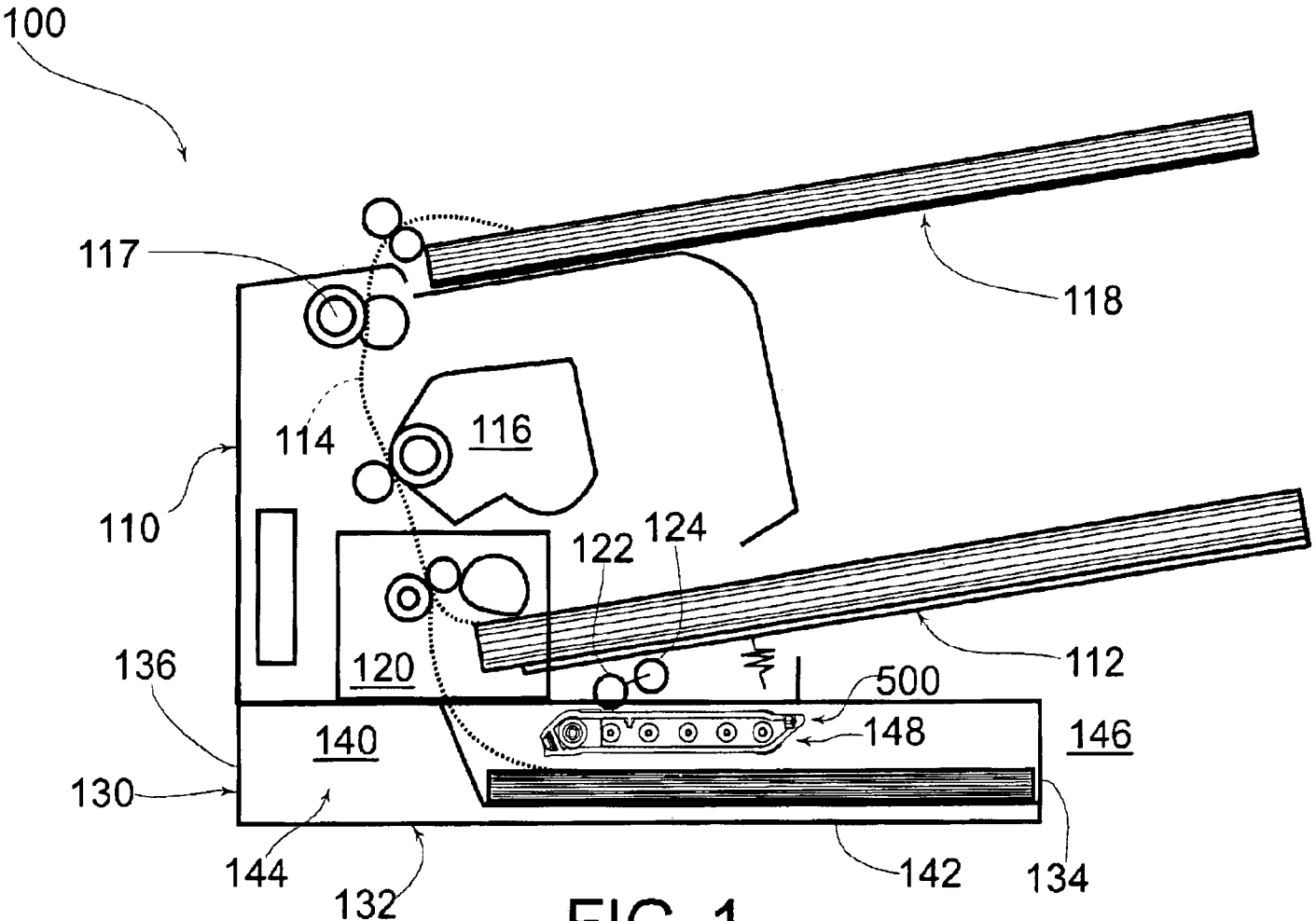
FIG. 1 shows a schematic side view of a printer provided with an auxiliary input tray and a pick assembly.

As schematically illustrated in FIG. 1, one type of media handling device referred to as a printer 100 may be provided with a housing 110. The printer housing 110 may contain various conventional elements that allow for images to be formed on sheets of media. The printer 100 may also be provided with a primary input tray 112, a path 114, an imaging device 116, a fuser 117, an output area 118 and a pick mechanism 120. The pick mechanism 120 may be located between the input tray 112 and the path 114. The path 114 may be connected to the imaging device 116, the fuser 117 and the output area 118. Furthermore, the printer 100 may be provided with a drive gear 122 and a motor 124. The drive gear 122 may be rotated by the motor 124.

FIG. 1 also illustrates that the printer 100 may be provided with an auxiliary input tray 130. The auxiliary input tray 130 may be provided with a housing 132. The auxiliary input tray housing 132 may be provided with a front 134, a back 136, a left side 138 (FIG. 2), a right side 140 and a bottom 142. The front 134, back 136, left side 138 and right side 140 may be formed in a somewhat parallelepiped configuration wherein the front 134 may be substantially parallel to the back 136; additionally, the left side 138 may be substantially parallel to the right side 140. The front 134, back 136, left side 138 and right side 140 may be formed on the bottom 142 thereby defining an internal portion 144 and an external portion 146.

It is to be understood that terms such as 'front', 'back', 'top', 'bottom', 'horizontal', 'vertical', 'underneath' and the like are used herein for illustrative purposes only. In actual use, the printer 100 can be configured and/or used in almost any orientation, thus making terms such as 'front', 'back', 'top', 'bottom', 'horizontal', 'vertical', etc. relative to the orientation of the printer 100.

Figure 2:
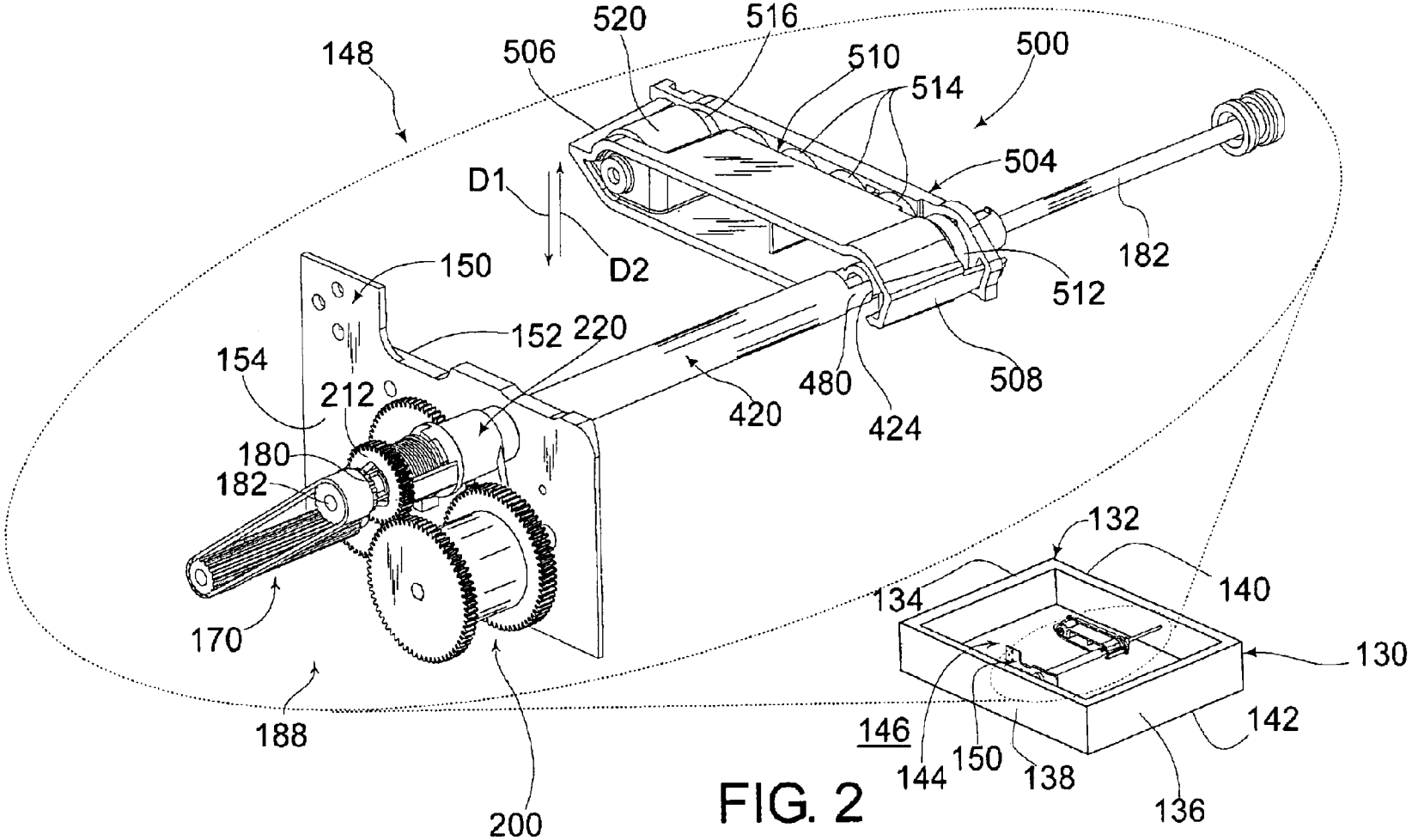
FIG. 2 shows a perspective view of exemplary components provided with an auxiliary tray, such as a clutch assembly and a pick assembly.

FIG. 2 illustrates components of an exemplary media handling device 148 contained within the auxiliary input tray 130. With reference to FIG. 2, the media handling device 148 may be provided with a bulkhead 150. The bulkhead 150 may take the form of a substantially 'flat' plate formed parallel to the right and left sides 138, 140, and may be formed perpendicular to the bottom 142. The bulkhead 150 may be provided with a first surface 152 and an oppositely disposed second surface 154.

Figure 3:
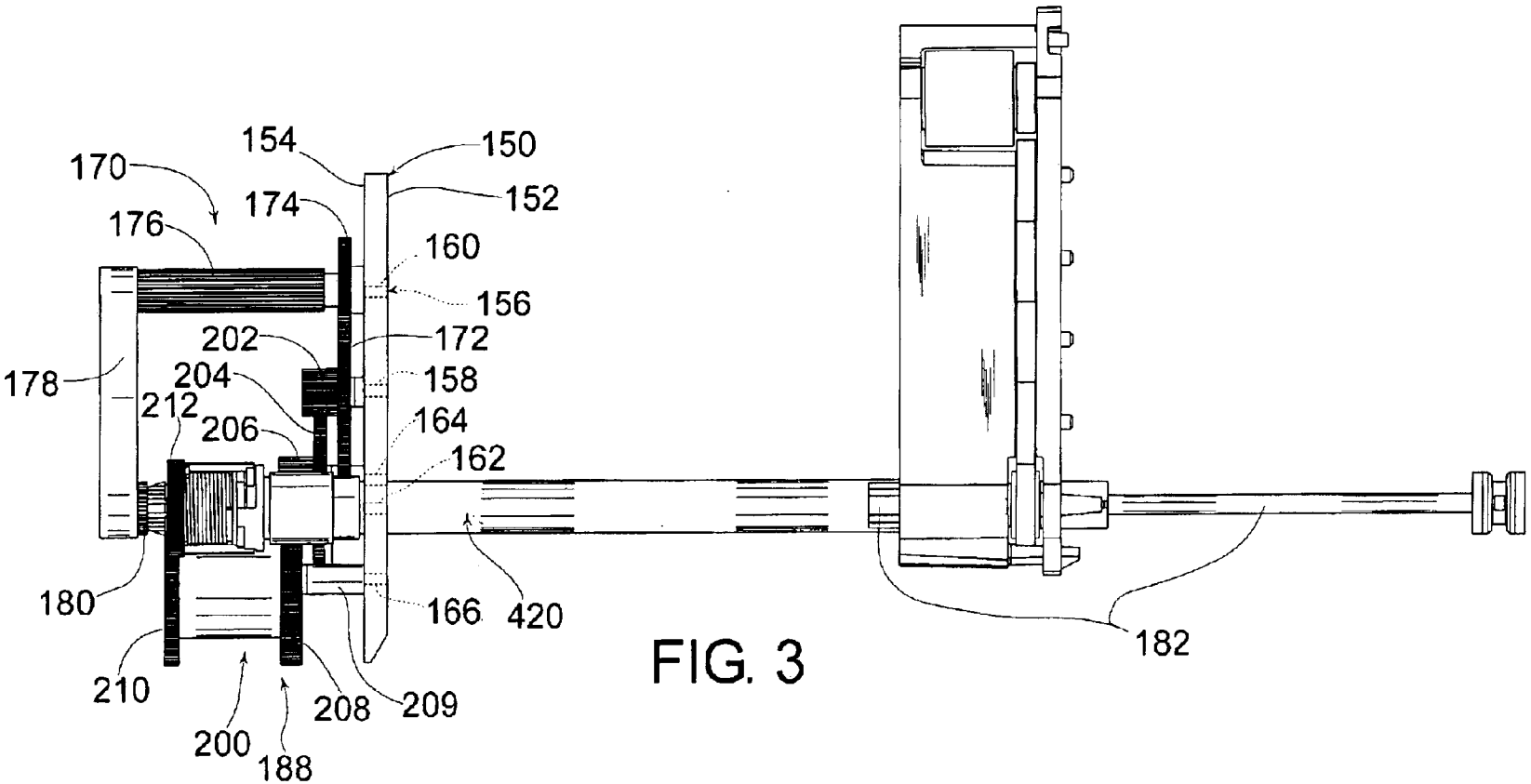
FIG. 3 shows a top plan view of the exemplary components illustrated in FIG. 2.

FIG. 3 illustrates a top plan view of the media handling device 148. With reference to FIG. 3, the bulkhead 150 may be further provided with a plurality of holes 156, such as a first hole 158, a second hole 160, a third hole 162, a fourth hole 164 and a fifth hole 166. The holes 158 may be formed in the bulkhead 150 thereby providing passage between the first and second surfaces 152, 154.

With reference to FIG. 2, the auxiliary input tray 130 may be further provided with a plurality of transmissions 188 such as a pick transmission 170 and a lift transmission 200.

With reference to FIG. 3, the pick transmission 170 may be provided with a first gear 172, a second gear 174, a third gear 176, a belt 178, a fourth gear 180 and a shaft 182. The first gear 172 may be rotationally supported by the bulkhead first hole 158. The second gear 174 may be rotationally supported by the bulkhead second hole 160. Additionally, the second gear 174 may be drivingly interfaced with the first gear 172. The third gear 176 may be integrally formed on the second gear 174; therefore, rotation of the second gear 174 may be mirrored by the third gear 176. The fourth gear 180 may be fixedly attached to the shaft 182; the fourth gear 180 and shaft 182 may be rotationally supported by the bulkhead third hole 162. The fourth gear 180 may be drivingly interfaced with the third gear 176 by the belt 178. Therefore, rotation of the first gear 172 causes rotation of the shaft 182 via the second, third and fourth gears 174, 176, 180 and the belt 182.

With continued reference to FIG. 3, the lift transmission 200 may be provided with a fifth gear 202, a sixth gear 204, a seventh gear 206, an eighth gear 208, a ninth gear 210 and a tenth gear 212. The fifth gear 202 may be integrally formed on the first gear 172, and, therefore, rotationally supported by the bulkhead first hole 158. The sixth gear 204 may be rotationally supported by the bulkhead fourth hole 164 and the sixth gear 204 may be drivingly interfaced with the fifth gear 202. The seventh gear 206 may be integrally formed on the sixth gear 204. The eighth gear 208 may be rotationally supported by the bulkhead fifth hole 166. The eighth gear 208 may be gearingly interfaced with the seventh gear 206. The ninth gear 210 may be integrally formed with the eighth gear 208; therefore, rotation of the seventh gear 206 may be mirrored by the sixth gear 204. The tenth gear 212 may be rotationally supported by the bulkhead third hole 162 in a manner that will be described later herein. Therefore, rotation of the first and fifth gears 172, 202 may cause rotation of the tenth gear 212 via the sixth, seventh, eighth and ninth gears 204, 206, 208 and 210.

Figure 4:
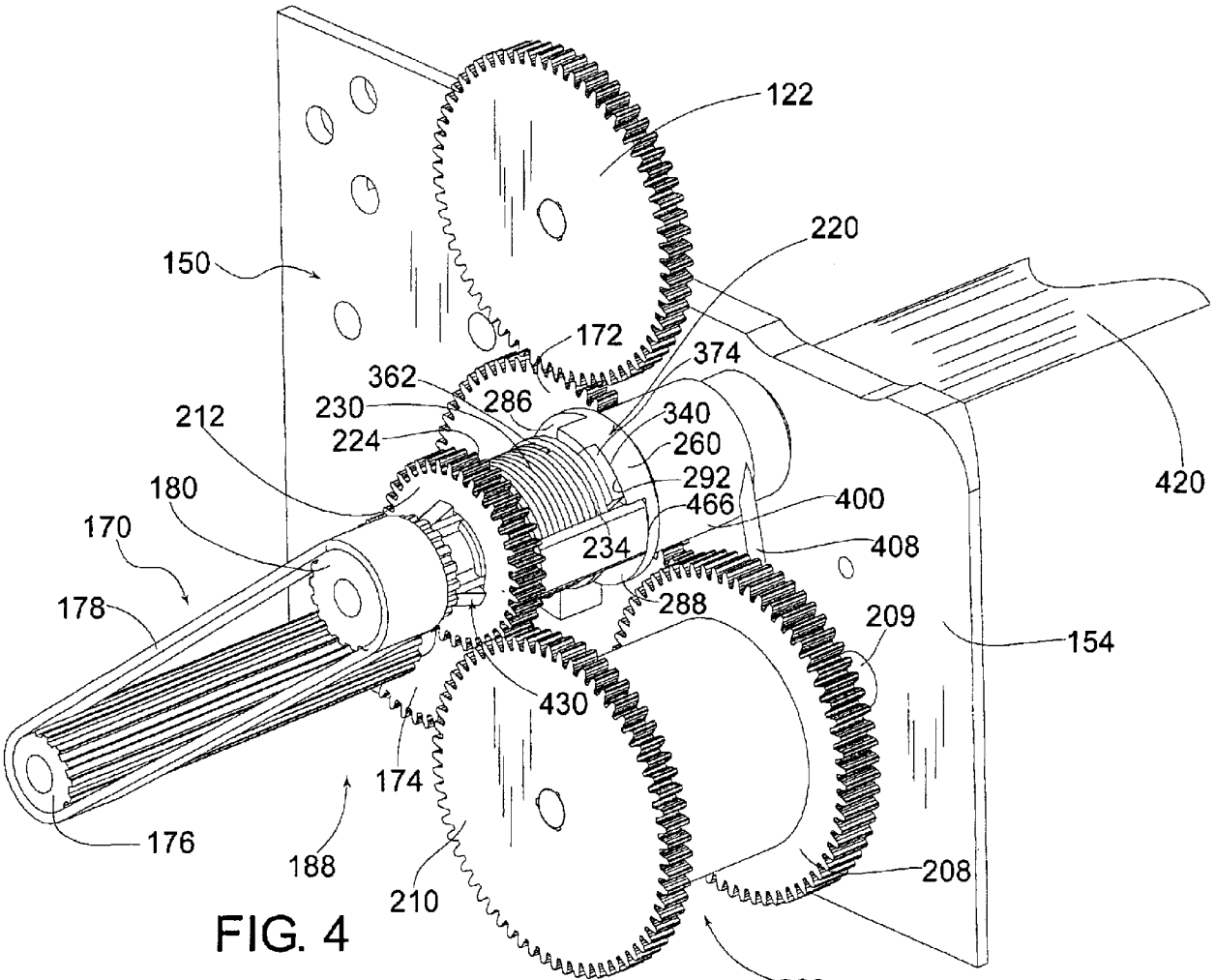
FIG. 4 shows a perspective view of exemplary components of the clutch assembly.

FIG. 4 illustrates a perspective view of the bulkhead 150 and the transmissions 188. With reference to FIG. 4, the media handling device 148 may be further provided with a clutch assembly 220. The clutch assembly 220 may be provided with a wrap spring 230, a spring support 260, a drive plate 340, a return spring 400 and a pickarm tube 420. Description of exemplary components of the clutch assembly 220 will now be provided.

Figure 5:
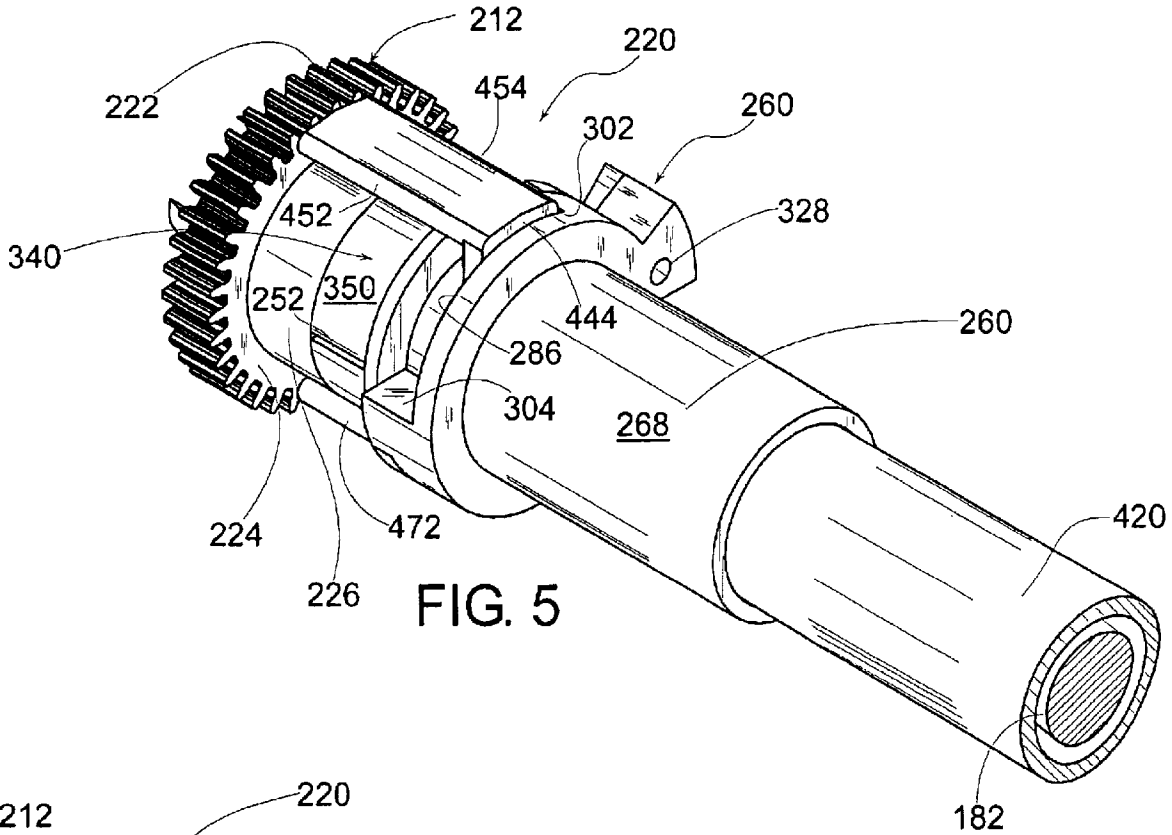
FIG. 5 shows a perspective view of an exemplary clutch assembly with various components removed therefrom (e.g. a wrap spring and a return spring).
Figure 6:
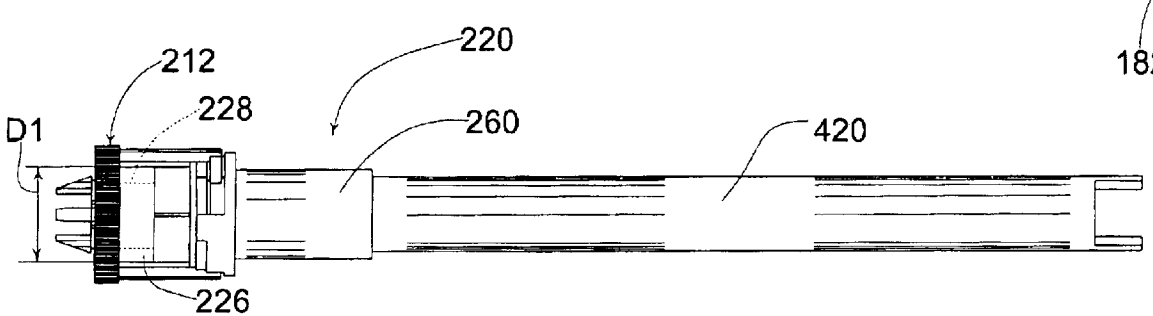
FIG. 6 shows a top plan view of the exemplary clutch assembly of FIG. 5.

FIGS. 5 and 6 illustrate views of the clutch assembly 220 with the wrap spring 230 (FIG. 4) and the return spring 400 (FIG. 4) removed therefrom. With reference to FIG. 5, the tenth gear 212 may be provided with a first surface 222 and an oppositely disposed second surface 224. The tenth gear 212 may be further provided with a shoulder 226 formed on the tenth gear second surface 224. This tenth gear shoulder 226 may have a circular cross-section defining a first diameter D1 (FIG. 6). The tenth gear 212 may also be provided with a hole 228 (FIG. 6) formed therethrough.

Figure 7:
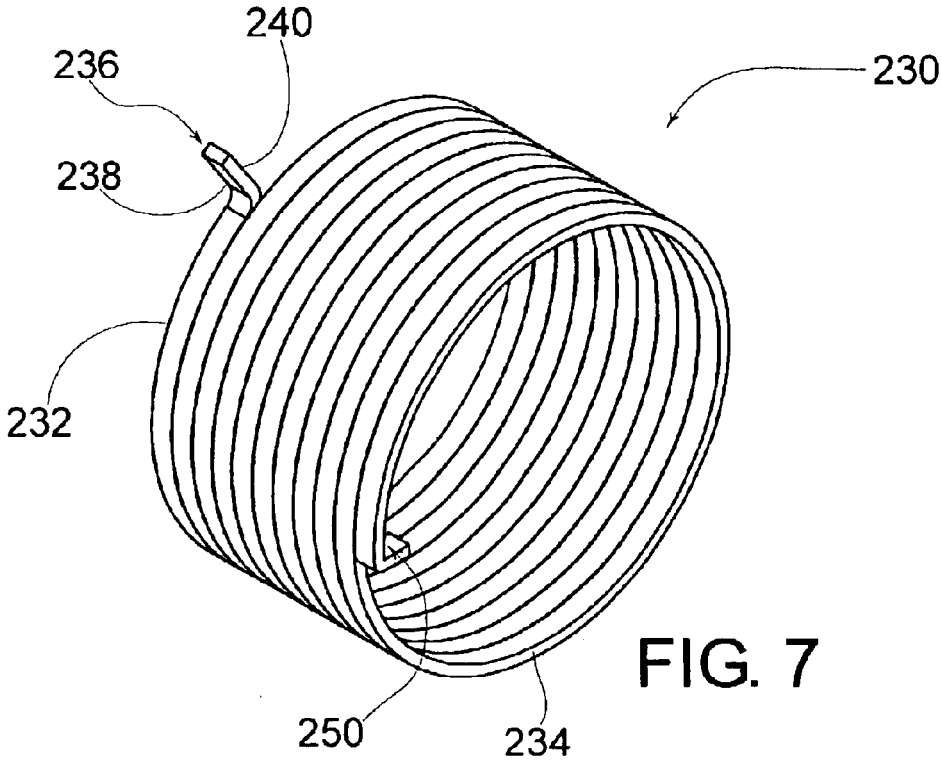
FIG. 7 shows a perspective view of an exemplary wrap spring.
Figure 8:
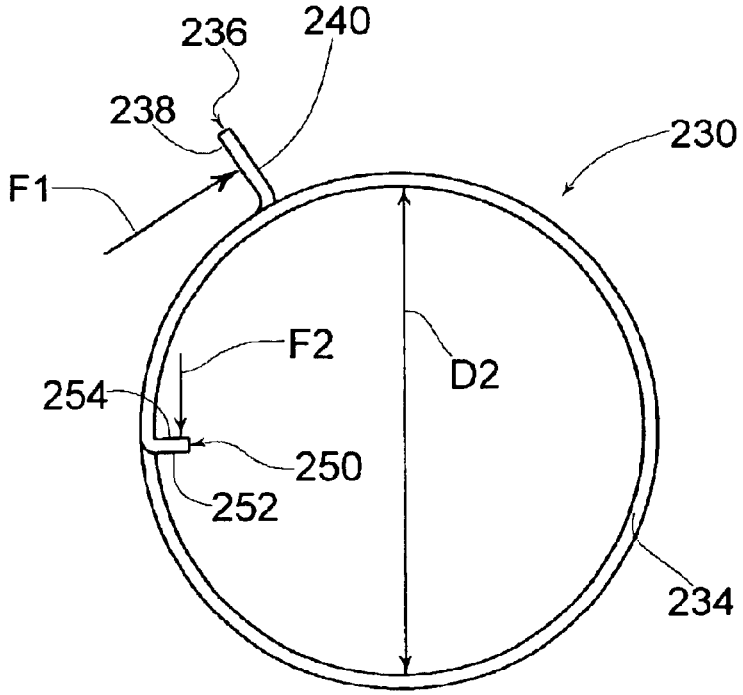
FIG. 8 shows a top elevation view of the exemplary wrap spring of FIG. 7.

FIGS. 7 and 8 illustrate the wrap spring 230. With reference to FIGS. 7 and 8, the wrap spring 230 may be provided with a first end 232 and a second end 234. The wrap spring first end 232 may be oppositely disposed from the second end 234. In one exemplary embodiment, the wrap spring 230 may be composed of one piece of material (e.g. spring steel) that may be wound into the configuration as illustrated in FIG. 7. The wrap spring 230 may be further provided with a control tang 236. The control tang 236 may be formed on the first end 232 such that it extends in a substantially radially-outward direction, as shown. The control tang 236 may be provided with a first surface 238 and an oppositely disposed second surface 240. The wrap spring 230 may be further provided with a reference tang 250. FIG. 8 illustrates a top plan view of the wrap spring 230. With reference to FIG. 8, the reference tang 250 may be formed on the wrap spring second end 234 such that it extends in a substantially radially-inward direction, as shown. The reference tang 250 may be provided with a first surface 252 and an oppositely disposed second surface 254. The wrap spring 230 may define a second diameter D2. This second diameter D2 may be the internal diameter of the wrap spring 230 as illustrated in FIG. 8. In one exemplary embodiment, the wrap spring second diameter D2 may be substantially similar to the tenth gear shoulder first diameter D1 (FIG. 6) defined by the shoulder 226 of the tenth gear 212. As will be described in further detail herein, the second diameter D2 may be reduced by applying a first force F1 to the first surface 238 of the control tang 236 and a second force F2 to the second surface 254 of the reference tang 250. Likewise, the second diameter D2 may be increased by applying forces to the second surface 240 of the control tang 236 and the first surface 252 of the reference tang 250.

Figure 9:
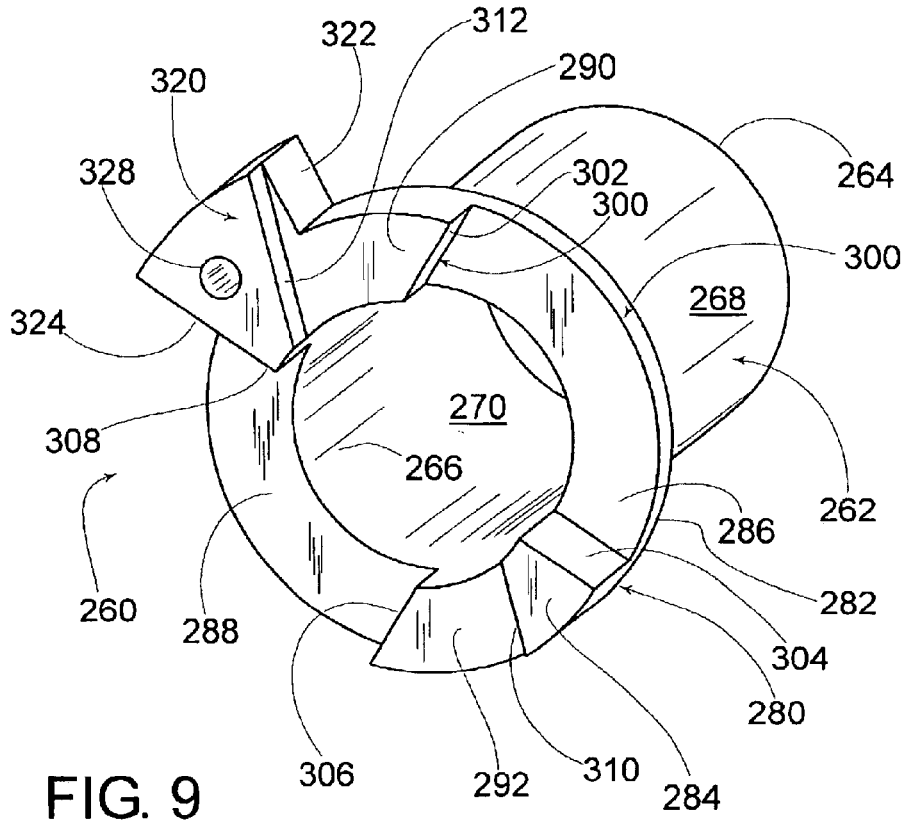
FIG. 9 shows a perspective view of a spring support that may be provided as a component of the exemplary clutch assembly of FIG. 5.
Figure 10:
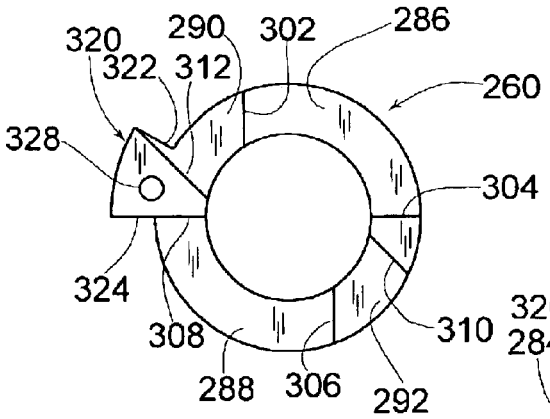
FIG. 10 shows a top plan view of the spring support of FIG. 9.
Figure 11:
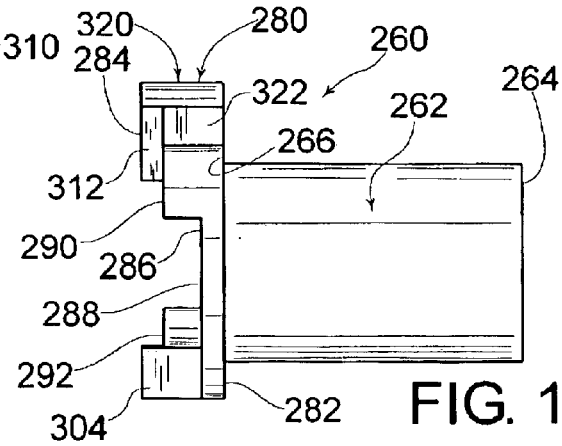
FIG. 11 shows a side elevation view of the spring support of FIG. 9.

FIGS. 9, 10 and 11 illustrate one exemplary embodiment of the spring support 260. With reference to FIG. 9, the spring support 260 may be provided with a collar 262. The collar 262 may be provided with a first surface 264 and an oppositely disposed second surface 266 (FIG. 11). The collar 262 may extend between the first and second surfaces 264, 266 defining an external surface 268 and an internal surface 270. The spring support 260 may be further provided with a shoulder 280. The spring support shoulder 280 may be provided with a first surface 282 and an oppositely disposed second surface 284. The shoulder 280 may be integrally formed on the collar 262 (thereby resulting in the collar second surface 266 being coplanar to the shoulder first surface 282). The shoulder second surface 284 may have a plurality of features formed therein, these various features will now be described.

With continued reference to FIG. 9, the shoulder 280 of the spring support 260 may be provided with a first surface 286 and a second surface 288. The shoulder first and second surfaces 286, 288 may reside on the same plane, as can be appreciated in FIG. 11. With continued reference to FIG. 9, the shoulder 280 may be further provided with a third surface 290 and a fourth surface 292. The shoulder third and fourth surfaces 290, 292 may reside on the same plane, as can also best be appreciated with reference to FIG. 11; furthermore, the third and fourth surfaces 290, 292 may be substantially parallel to, and offset from, the first and second surfaces 286, 288.

With continued reference to FIG. 9, the spring support shoulder 280 may also be provided with a plurality of stops 300, such as a first stop 302, a second stop 304, a third stop 306, a fourth stop 308, a fifth stop 310 and a sixth stop 312. The shoulder first stop 302 may extend between the first surface 286 and the third surface 290. The shoulder second stop 304 may extend between the first surface 286 and the shoulder second surface 284. The shoulder third stop 306 may extend between the second surface 288 and the fourth surface 292. The shoulder fourth stop 308 may extend between the second surface 288 and the shoulder second surface 284. The shoulder fifth stop 310 may extend between the fourth surface 292 and the shoulder second surface 284. The shoulder sixth stop 312 may extend between the third surface 290 and the shoulder second surface 284.

As illustrated in FIG. 9, the spring support 260 may be further provided with a fork protrusion 320. The fork protrusion 320 may be formed on the shoulder 280 generally between the shoulder fourth stop 308 and the shoulder sixth stop 312. The fork protrusion 320 may be provided with a seventh stop 322 and an eighth stop 324. The seventh stop 322 may be formed generally between the shoulder sixth stop 312 and the shoulder first stop 302. The shoulder eighth stop 324 may be formed generally coplanar to the shoulder fourth stop 308. Additionally, the spring support fork protrusion 320 may be provided with a spring hole 328. The spring hole 328 may extend between the shoulder first and second surfaces 282, 284.

Figure 12:
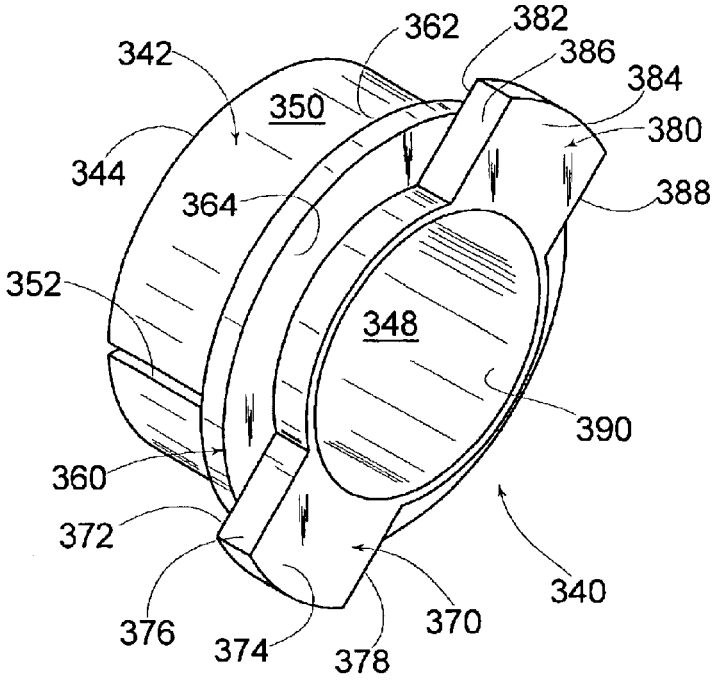
FIG. 12 shows a perspective view of a drive plate that may be provided as a component of the exemplary clutch assembly of FIG. 5.
Figure 13:
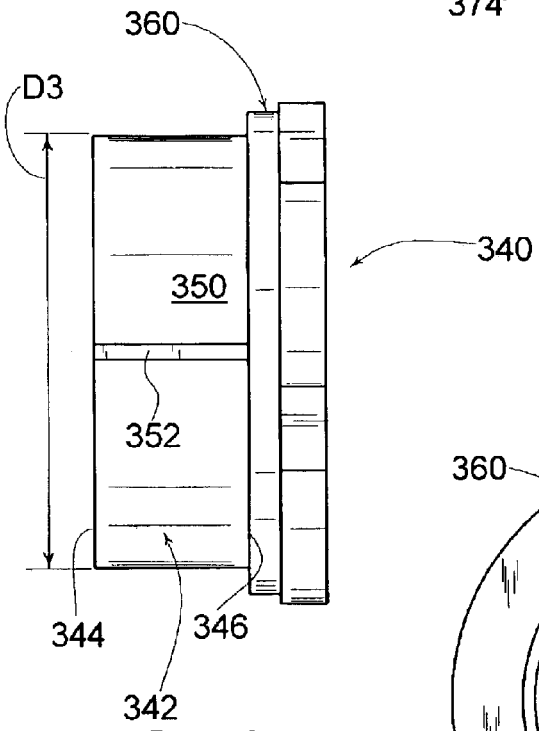
FIG. 13 shows a side elevation view of the drive plate of FIG. 12.
Figure 14:
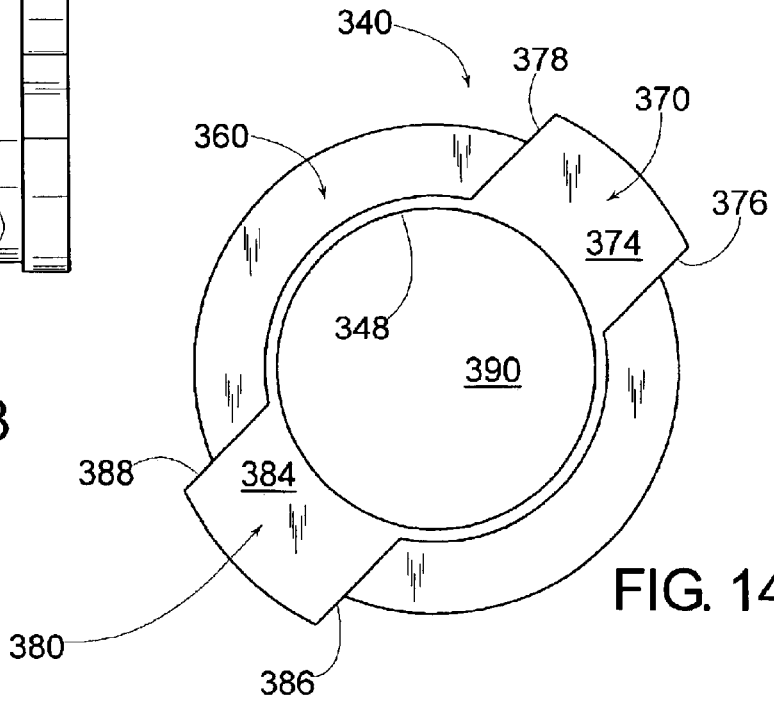
FIG. 14 shows a top plan view of the drive plate of FIG. 12.

FIGS. 12, 13 and 14 illustrate one exemplary embodiment of the drive plate 340. With reference to FIG. 12, the drive plate 340 may be provided with a collar 342. The collar 342 may be provided with a first surface 344 and an oppositely disposed second surface 346 (FIG. 13). The collar 342 may be provided with an internal surface 348 and an external surface 350. The drive plate collar 342 may have a generally round configuration defining a third diameter D3, FIG. 13. The drive plate third diameter D3 may be substantially similar to the tenth gear collar first diameter D1 defined by the collar 226 of the tenth gear 212, FIG. 6. The drive plate collar 342 may be provided with a slot 352 formed in the external surface 350 and extending from the first surface 344 towards the second surface 346. The drive plate 340 may be further provided with a shoulder 360. The drive plate shoulder 360 may be provided with a first surface 362 and an oppositely disposed second surface 364. The drive plate shoulder first surface 362 may be coplanar to the drive plate collar second surface 346. The drive plate 340 may be further provided with a first protrusion 370. The drive plate first protrusion 370 may be provided with a first surface 372 and an oppositely disposed second surface 374. The first surface 372 of the first protrusion 370 may be coplanar to the drive plate shoulder second surface 364. The first protrusion 370 may be further provided with a first stop 376 and an oppositely disposed second stop 378. The first protrusion first stop 376 may extend between the first protrusion first and second surfaces 372, 374. Additionally, the first protrusion second stop 378 may extend between the first and second surfaces 372, 374 of the first protrusion 370.

With continued reference to FIG. 12, the drive plate 340 may be further provided with a second protrusion 380. The second protrusion 380 may be provided with a first surface 382 and an oppositely disposed second surface 384. The second protrusion first surface 382 may be coplanar to the drive plate shoulder second surface 364. The drive plate second protrusion 380 may be further provided with a first stop 386 and an oppositely disposed second stop 388. The second protrusion first stop 386 may extend between the drive plate second protrusion first surface 382 and the drive plate second protrusion second surface 384. Additionally, the second protrusion second stop 388 may extend between the drive plate second protrusion first surface 382 and the drive plate second protrusion second surface 384. The drive plate 340 may be provided with a hole 390 extending between the first and second protrusions 370, 380 and the drive plate collar first surface 344.

Figure 15:
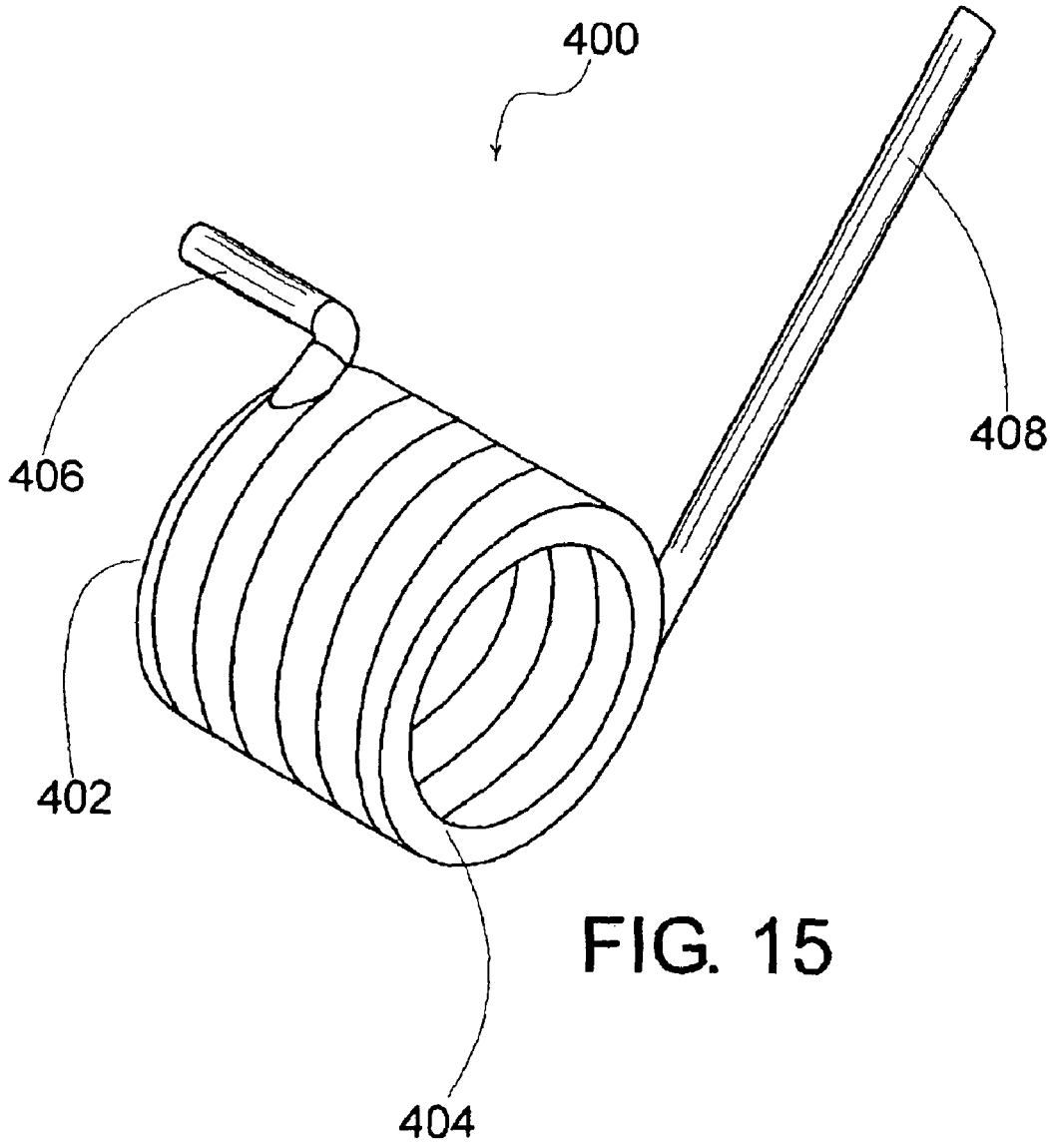
FIG. 15 shows a perspective view of a return spring that may be provided as a component of the exemplary clutch assembly of FIG. 5.

With reference to FIG. 4, the printer clutch assembly 220 may be further provided with the return spring 400. It should be noted that the return spring 400 may, for example, be a torsion spring, although FIGS. 4 and 15 illustrate the return spring 400 as a simplified 'tube' having two tangs. With reference to FIG. 15, the return spring 400 may be provided with a first end 402 and a second end 404. The return spring first end 402 may be oppositely disposed from the second end 404. In one exemplary embodiment, the return spring 400 may be composed of one piece of material (e.g. spring steel) that may be wound into the configuration as illustrated in FIG. 15. The return spring 400 may be further provided with a first tang 406. The first tang 406 may be formed on the return spring first end 402 such that it extends axially from the return spring first end 402. The return spring 400 may be further provided with a second tang 408. The second tang 408 may be formed on the return spring second end 404 such that it extends in a radially-outward direction.

Figures 16, 17, 18:
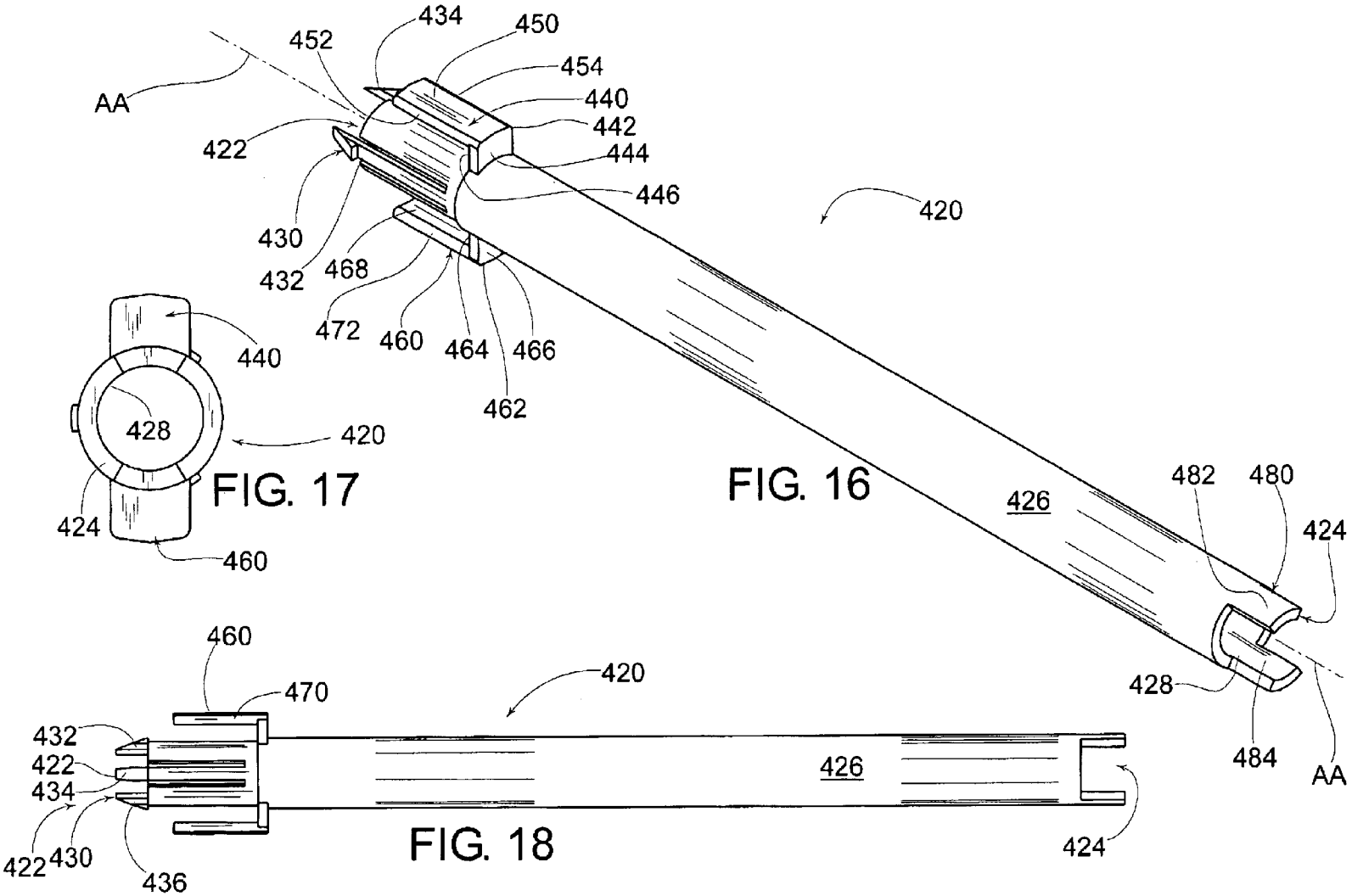
FIG. 16 shows a perspective view of a pickarm tube that may be provided as a component of the exemplary clutch assembly of FIG. 5.
FIG. 17 shows a top plan view of the pickarm tube of FIG. 16.
FIG. 18 shows a side elevation view of the pickarm tube of FIG. 16.

FIGS. 16, 17 and 18 illustrate one exemplary embodiment of the pickarm tube 420. With reference to FIG. 16, the printer clutch assembly pickarm tube 420 may be provided with a first end 422 and an oppositely disposed second end 424. The pickarm tube 420 may have a substantially tubular shape defining an external surface 426. The pickarm tube 420 may be provided with a hole 428 formed between the first and second ends 422, 424; this hole 428 may define a longitudinal axis 'AA'. With reference to FIG. 18, the pickarm tube 420 may be provided with a plurality of cantilever tabs 430. The cantilever tabs 430 may include a first cantilever tab 432, a second cantilever tab 434 and a third cantilever tab 436. The cantilever tabs 430 may be formed on the pickarm tube first end 422.

With reference to FIG. 16, the pickarm tube 420 may be further provided with a pair of control forks 440. The control forks 440 may include a first control fork 442 and a second control fork 460. The first control fork 442 may be provided with a first portion 444 that may, for example, extend at a substantial right angle to the longitudinal axis AA of the tube 420. The first control fork first portion 444 may be provided with a first surface 446 and an oppositely disposed second surface 448. The first control fork 442 may be further provided with a second portion 450 that may, for example, extend at a substantially right angle with respect to the first portion 444. The first control fork second portion 450 may be integrally formed on the first control fork first portion 444. The first control fork second portion 450 may be provided with a first surface 452 and an oppositely disposed second surface 454.

The second control fork 460 may be provided with a first portion 462 that may, for example, extend at a substantially right angle to the longitudinal axis AA of the tube 420. The second control fork first portion 462 may be provided with a first surface 464 and an oppositely disposed second surface 466. The second control fork 460 may be further provided with a second portion 468 that may, for example, extend at a substantially right angle with respect to the first portion 462. The second control fork second portion 468 may be integrally formed with the second control fork first portion 462. The second control fork second portion 468 may be provided with a first surface 470 (FIG. 18) and an oppositely disposed second surface 472.

Additionally, the pickarm tube 420 may be provided with a key 480. The key 480 may be formed on the pickarm tube second end 424. The pickarm tube key 480 may be provided with a first protrusion 482 and a second protrusion 484.

With reference to FIG. 2, the printer 100 may be further provided with a pick assembly 500. The pick assembly 500 may be provided with a housing 504. The housing 504 may define a first end 506 and an oppositely disposed second end 508. The pickarm assembly 500 may be provided with a transmission 510 contained within the housing 504. The transmission 510 may be provided with an input gear 512, a plurality of idler gears 514, and an output gear 516. The transmission input gear 512 may be attached to the pick transmission shaft 182 generally near the housing second end 508. The plurality of idler gears 514 may be drivingly interfaced with the input gear 512. The transmission output gear 516 may be drivingly interfaced with the idler gears 514. The pickarm assembly 500 may be further provided with a pick tire 520. The pick tire 520 may be attached to the transmission output gear 516 generally near the pickarm assembly first end 506. As will be described later herein, rotation of the pick transmission shaft 182 causes rotation of the pick tire 520 via the transmission 510. It should be noted that the pickarm assembly 500 may be fixedly interfaced with the pickarm tube 420 with the key 480.

Having provided exemplary components of one exemplary embodiment of the media handling device 148, assemblage thereof will now be provided.

With reference to FIG. 4 the transmissions 188 and clutch assembly 220 may be configured such that the pickarm tube 420 may be rotationally supported by the bulkhead third hole 162 (FIG. 3). As can be appreciated, rotationally supporting the pickarm tube 420 in this manner allows the pickarm tube 420 to rotate within the bulkhead third hole 162 (FIG. 3). The return spring 400 may be captured between the bulkhead second surface 154 and the spring support 260. The captured return spring 400 may be positioned such that the its inner surface circumferentially contacts the spring support external surface 268 (FIG. 5). Additionally, the return spring first tang 406 (FIG. 15) may be positioned in the spring support spring hole 328 (FIG. 5) of the spring support 260. With further reference to FIG. 4, the return spring second tang 408 (FIG. 15) may contact a standoff 209 captured between the eighth gear 208 and the bulkhead second surface 154.

When configured as illustrated in FIG. 4, the pickarm tube first surface 444 (FIG. 16) may slidingly contact the spring support shoulder first surface 286; furthermore, the pickarm tube second surface 466 (FIG. 16) may slidingly contact the spring support shoulder second surface 288. With reference to FIG. 5, the spring support 260 may rotate with respect to the pickarm tube 420 so long as the second surface 454 is not in contact with the spring support shoulder first stop 302. Additionally, the spring support 260 may rotate with respect to the pickarm tube 420 so long as the first surface 452 is not in contact with the spring support shoulder second stop 304. Additionally the spring support 260 may rotate with respect to the pickarm tube 420 so long as the first surface 470 (FIG. 18) is not in contact with the spring support shoulder fourth stop 308 (FIG. 9). And, the spring support 260 may rotate with respect to the pickarm tube 420 so long as the second surface 472 is not in contact with the spring support shoulder third stop 306 (FIG. 9).

With reference to FIG. 4, the clutch assembly drive plate 340 may be positioned adjacent to the spring support 260 and the pickarm tube 420. This positioning results in the drive plate first protrusion second surface 374 slidingly contacting the spring support shoulder fourth surface 292. Additionally, the drive plate second protrusion second surface 384 may slidingly contact the spring support shoulder third surface 290. Therefore, the drive plate 340 may rotate with respect to the spring support 260 so long as the following conditions are met: a) the drive plate first protrusion first stop 376 (FIG. 9) is not in contact with the spring support shoulder fifth stop 310 (FIG. 9), and b) the drive plate second protrusion first stop 386 is not in contact with the spring support shoulder sixth stop 312 (FIG. 9).

With continued reference to FIG. 4, the wrap spring 230 may be assembled in the clutch assembly 220 as shown. This assemblage results in the wrap spring second end 234 contacting the drive plate shoulder first surface 362. Furthermore, the wrap spring reference tang 250 (FIG. 7) may be positioned in the drive plate collar slot 352 (FIG. 5). This positioning may also result in a portion of the internal surface of the wrap spring 230 contacting the drive plate collar external surface 350 (FIG. 5).

With continued reference to FIG. 4, the clutch assembly 220 may be further assembled by attaching the lift transmission tenth gear 212 with the pickarm tube 420. This attachment results in the tenth gear shoulder 226 (FIG. 5) contacting a portion of the internal surface of the wrap spring 230. Furthermore, the wrap spring first end 232 (FIG. 7) may slidingly contact the tenth gear second surface 224. The tenth gear 212 may be attached to the pickarm tube 420 via the plurality of cantilever tabs 430.

With reference to FIG. 2, the present printer 100 may be further assembled by positioning the pick transmission shaft 182 in the pickarm tube hole 428 (FIG. 16). When positioning the pick transmission shaft 182 into the pickarm tube hole 428, the pick transmission fourth gear 180 will contact the pickarm tube first end 422 (FIG. 16). Furthermore, the pick assembly 500 may be attached to the pickarm tube second end 424. One method of attaching the pick assembly 500 to the pickarm tube 420 may occur by the key 480. When attaching the pick assembly 500 to the pickarm tube 420, the pickarm transmission input gear 512 may be fixedly attached to the pick transmission shaft 182.

Figure 19:
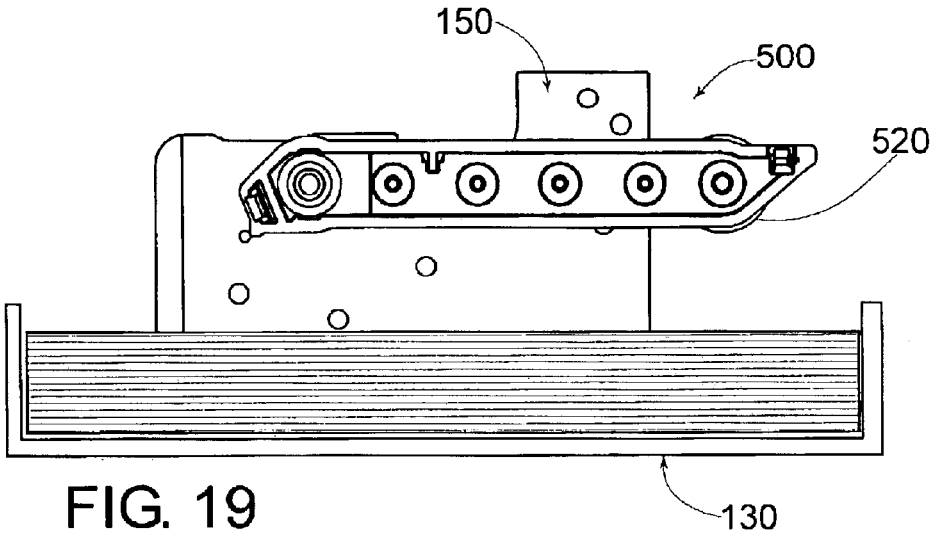
FIG. 19 shows a schematic side elevation view of the pick assembly in an idle condition.
Figure 20:
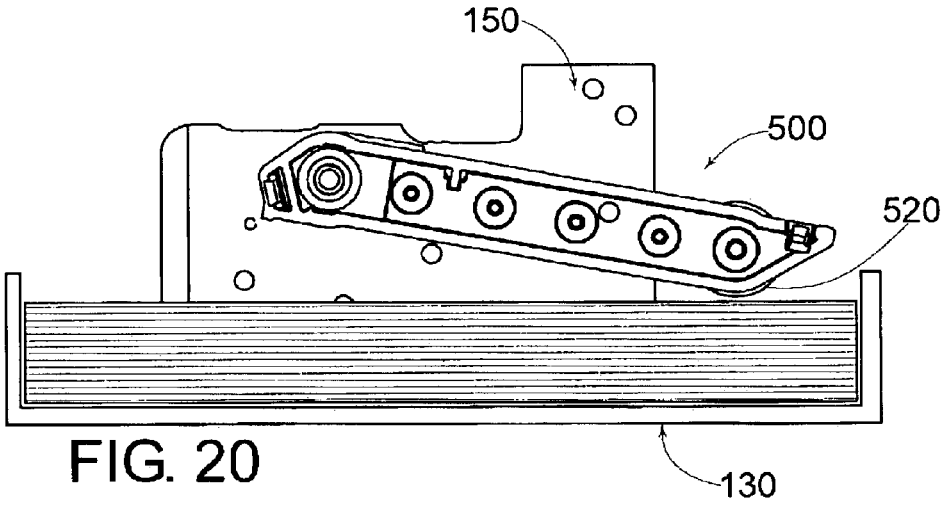
FIG. 20 shows a schematic side elevation view of the pick assembly in a first pick condition wherein the pick assembly is contacting a stack.
Figure 21:
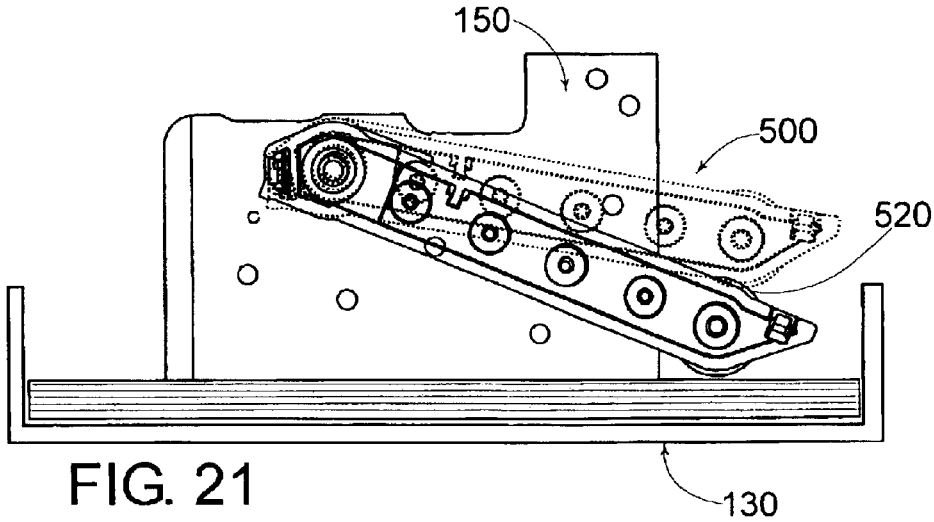
FIG. 21 shows a schematic side elevation view of the pick assembly in a second pick condition, the dashed-lines represent the location of the pick assembly when located in the first pick condition of FIG. 20.

Having described exemplary components of the present media handling device, the operation thereof will now be discussed. FIGS. 19, 20 and 21 illustrate the present media handling device 100 (FIG. 1) being used to pick media contained in the auxiliary input tray 130. This process of picking may result in movement of the pick assembly 500 as illustrated in FIGS. 19, 20 and 21. FIG. 19 illustrates a 'snap shot' of this picking process when the printer 100 is in an idle condition (i.e. it is not active and simply waiting for printing instructions). FIG. 20 illustrates a 'snap shot' of this picking process when the printer 100 is in a first picking condition. FIG. 21 illustrates a 'snap shot' of this picking process when the printer 100 is in a second picking condition. It should be noted that the first picking condition (FIG. 20) may be substantially similar to the second picking condition (FIG. 21) except that the stack has reduced in thickness.

With reference to FIG. 19, when the printer 100 is in the idle condition, the pick assembly 500 may be in an idle position. In this idle condition, the drive gear 122 (FIG. 1) may be stationary and the pick tire 520 may, also, be stationary (i.e. not rotating). Furthermore, the pick assembly 500 may be held in its position by the force exerted by the return spring 400 (FIG. 4) onto the pickarm tube 420 (FIG. 4). It should be noted that a reactionary force may be applied to the standoff 209 (FIG. 4) via the return spring second tang 408 (FIG. 4).

With reference to FIG. 2, when the printer 100 is directed to pick media contained in the auxiliary input tray 130, the motor 124 (FIG. 1) rotates the drive gear 122 (FIG. 1). This rotating of the drive gear 122 transfers rotational energy to the pick transmission 170 and the lift transmission 200. The rotating pick transmission 170 causes the pick tire 520 (FIG. 2) to rotate via the pick transmission shaft 182, the pick assembly transmission input gear 512, idler gears 514 and output gear 516. When the drive gear 122 is rotating, the pick tire 520 is rotating. This rotation of the drive gear 122 may also be utilized to move the first end 506 of the pick assembly 500 in the first direction D1. By moving in the first direction D1, the pick tire 520 of the pick assembly 500 eventually contacts the stack located in the auxiliary input tray 130. When the pick assembly 500 is being driven towards the stack, the tenth gear 212 may be rotated via the pick transmission 200. The rotating tenth gear 212 may cause the wrap spring 230 (FIG. 4) to engage (i.e. fixedly engage) the tenth gear collar 226 (FIG. 5). Once the pick assembly 500 has been moved into the first pick position illustrated in FIG. 20, the pick tire 520 contacts the stack. During this movement of the pick assembly 500, the return spring 400 may store energy (this stored energy will be utilized to return the pick assembly 500 in a process that will be described later herein). This contact between the pick tire 520 and the stack may cause the second diameter D2 of the wrap spring 230 (FIG. 9) to be reduced through the interaction of the wrap spring 230 and the pickarm tube 420 (FIG. 6). This interaction may occur by one of the pickarm tube forks 440 (e.g. the first fork 442) contacting the wrap spring control tang 236 (FIG. 7). When the first fork 442 contacts the control tang 236, the wrap spring second diameter D2 increases to allow the tenth gear collar 226 (FIG. 5) to slide against the internal portion of the wrap spring 230. By sliding against the wrap spring 230, the tenth gear 226 limits the amount of energy transferred from the lift transmission 200 to the pickarm tube 420. As the pick assembly 500 feeds sheets of media from the stack to the printer path 114, the stack reduces in thickness. This thickness reduction requires the pickarm assembly 500 to move further in the first direction D1. When moving further in the first direction D1, the return spring 400 stores energy that will be used to return the spring to the idle position illustrated in FIG. 19.

Once the printing process is complete, the motor 124 stops rotating. This stoppage of the motor 124 causes stoppage of rotation of the transmissions 188. At this point, the pick assembly 500 may be returned to the idle position (illustrated in FIG. 19) by the return spring 400. The return spring 400 transmits torque to the spring support 260 (FIG. 4) via the spring support fork protrusion spring hole 328 (FIG. 5). When transmitting this torque to the spring support 260, the pickarm tube 420 is rotated such that the pickarm assembly 500 rotates in a second direction D2 (FIG. 2).

This media handling device is able to receive input from one gear. This input may be utilized to not only pick media with the pick tire, but also store energy in the return spring. By storing this energy in the return spring, the pick assembly can be returned to its idle position upon completion of a print operation.

While illustrative embodiments have been described in detail herein, it is to be understood that the inventive concepts may be otherwise variously embodied as previously mention. For example, although the present device has been described as being employed in a printer, it may also be used in other imaging devices such as those commonly referred to as scanners, copiers, all-in-one devices, etc. Therefore, the appended claims are intended to be construed to include such variations except insofar as limited by the prior art.

What is claimed is:

1. A method of picking media from a stack, said method comprising:

providing a pick assembly;

providing a transmission;

providing a clutch assembly disposed between said pick assembly and said transmission;

rotating said transmission;

activating said clutch assembly to drivingly engage said transmission to said pick assembly;

providing a return spring;

storing energy in said return spring during said rotating said transmission;

stopping said rotating of said transmission; and after said stopping using said return spring to move said pick assembly out of contact with said stack.

2. The method of claim 1 wherein said providing said clutch assembly comprises providing a wrap spring defining a diameter; and wherein said activating said clutch assembly comprises reducing said wrap spring diameter.

3. The method of claim 1 and further comprising:

after said activating said clutch, moving said pick assembly into contact with said stack.

* * * * *